US006855025B2

(12) United States Patent
Iwasaki et al.

(10) Patent No.: US 6,855,025 B2
(45) Date of Patent: Feb. 15, 2005

(54) STRUCTURE AND A PROCESS FOR ITS PRODUCTION

(75) Inventors: Tatsuya Iwasaki, Atsugi (JP); Tohru Den, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/178,843

(22) Filed: Jun. 25, 2002

(65) Prior Publication Data

US 2002/0167256 A1 Nov. 14, 2002

Related U.S. Application Data

(62) Division of application No. 09/178,422, filed on Oct. 26, 1998, now Pat. No. 6,525,461.

(30) Foreign Application Priority Data

Oct. 30, 1997 (JP) ..... 9-298662
Oct. 19, 1998 (JP) ..... 10-313939

(51) Int. Cl.[7] ..... H01J 1/62; H01J 9/24

(52) U.S. Cl. ..... 445/24; 445/25; 445/50; 313/309; 313/310

(58) Field of Search ..... 313/309, 311, 313/310, 308, 495, 346 R, 336, 351; 445/50–51, 52, 24–25; 438/707; 257/9, 30; 423/447.3

(56) References Cited

U.S. PATENT DOCUMENTS 3,378,345 A * 4/1968 Bourdeau et al. ..... 423/447.3
3,783,325 A 1/1974 Shelton ..... 313/336
4,163,918 A 8/1979 Shelton ..... 313/309
4,345,181 A 8/1982 Shelton ..... 313/309
4,379,250 A 4/1983 Hosoki et al. ..... 313/336
4,816,289 A * 3/1989 Komatsu et al. ..... 423/447.3
5,053,673 A * 10/1991 Tomii et al. ..... 313/308
5,164,632 A 11/1992 Yoshida et al. ..... 313/309
5,552,659 A * 9/1996 Macaulay et al. ..... 313/310
5,581,091 A 12/1996 Moskovits et al. ..... 257/9
5,648,699 A * 7/1997 Jin et al. ..... 313/309
5,650,370 A * 7/1997 Tennent et al. ..... 502/174
5,773,921 A 6/1998 Keesmann et al. ..... 313/309

(List continued on next page.)

FOREIGN PATENT DOCUMENTS

| | | |
|---|---|---|
| DE | 196 02 595 A1 | 7/1997 |
| EP | 0 351 110 A1 | 1/1990 |
| EP | 0 364 964 A2 | 4/1990 |
| EP | 0 758 028 A2 | 2/1997 |
| JP | 8-115652 | 5/1996 |
| WO | WO 89/07163 A1 | 8/1989 |
| WO | WO 90/07023 A1 | 6/1990 |
| WO | 95/07543 A1 | 3/1995 |
| WO | WO 98/05920 A1 | 2/1998 |
| WO | 98/48456 A1 | 10/1998 |

OTHER PUBLICATIONS

Christian Coddet et al., "Metallography: Growth of Crichites During Oxidation of Titanium or of the Alloy TA6V4 By Steam at High Temperature," *C.R. Acad. Sc. Paris*, t. 281, Series C, pp. 507–510 (Sep. 29, 1975) (with translation).

(List continued on next page.)

*Primary Examiner*—Vip Patel
*Assistant Examiner*—Dalei Dong
(74) *Attorney, Agent, or Firm*—Fitzpatrick, Cella, Harper & Scinto

(57) ABSTRACT

Disclosed herein is a process for producing a narrow titanium-containing wire, comprising steps of:

(i) providing a structure comprising a substrate having a titanium-containing surface and a porous layer containing narrow pores extending towards the surface; and (ii) forming narrow titanium-containing wires in the respective narrow pores by heat treatment of the structure obtained in the step (i).

19 Claims, 5 Drawing Sheets

U.S. PATENT DOCUMENTS

| | | | | | |
|---|---|---|---|---|---|
| 5,825,122 | A | | 10/1998 | Givargizov et al. | 313/336 |
| 5,872,422 | A | * | 2/1999 | Xu et al. | 313/311 |
| 5,913,704 | A | * | 6/1999 | Spindt et al. | 445/24 |
| 5,967,873 | A | | 10/1999 | Rabinowitz | 455/50 |
| 5,973,444 | A | * | 10/1999 | Xu et al. | 313/309 |
| 6,038,060 | A | * | 3/2000 | Crowley | 359/328 |
| 6,113,451 | A | | 9/2000 | Hobart et al. | 445/50 |
| 6,137,212 | A | * | 10/2000 | Liu et al. | 313/308 |
| 6,250,984 | B1 | * | 6/2001 | Jin et al. | 445/51 |
| 6,319,082 | B1 | * | 11/2001 | Hirano et al. | 445/24 |
| 6,322,713 | B1 | * | 11/2001 | Choi et al. | 216/38 |
| 6,514,113 | B1 | * | 2/2003 | Lee et al. | 445/50 |
| 6,525,461 | B1 | * | 2/2003 | Iwasaki et al. | 313/495 |
| 6,617,772 | B1 | * | 9/2003 | Barton et al. | 313/292 |
| 6,628,053 | B1 | * | 9/2003 | Den et al. | 313/310 |

OTHER PUBLICATIONS

Patent Abstract of Japan, vol. 18, No. 345 (E–1571) Jun. 1994 (JP 06–089651).

Dmitri Routkevitch et al., "Nonlithographic Nano–Wire Arrays: Fabrication, Physics, and Device Applications," 43(10) *IEEE Trans. Elec. Dev.* 1646–1648 (1996).

P. Hoyer et al., "Electrodeposited Nanoporous $TiO_2$ Film by a Two–Step Replication Process from Anodic Porous Alumina," 15 *E. Lett.* 1228–1230 (1996).

Dmitri Routkevitch et al., "Porous Anodic Alumina Templates for Advanced Nanofabrication," 97–7 *Electrochem. Soc. Proc.* 350–357 (1997).

Yoichiro Masuda et al., "Crystal Growth, Dielectric and Polarization Reversal Properties of $Bi_3Ti_4O_{12}$ Single Crystal," 31 *Jpn. J. Appl. Phys.* 3108–3112 (1992).

D. Al–Mawlawi et al., "Nanowires Formed in Anodic Oxide Nanotemplates," 9(4) *J. Mater. Res.* 1014–1018 (1994).

Hidefumi Harada et al., "Preparation and Mechanical Properties of AC8A Aluminum Alloy Composite Reinforced with Potassium Titanate Whisker," 58(1) *J. Japan Inst. Metals* 69–77 (1994).

C.A. Huber et al., "Nanowire Array Composites," 263 *Science* 800–802 (1994).

R.C. Furneaux et al., "The Formation of Controlled–Porosity Membranes from Anodically Oxidized Aluminum," 337 *Nature* 147–149 (1989).

H. Masuda et al., "Preparation of Microporous Polymer Films by Using Anodic Porous Alumina as Template," 43 (8) *Surface Techniques* 66–67 (1992).

N. Masuda, 31(5) *Solid State Physics* 493–499 (1996).

Takashi Kyotani et al., "Preparation of Ultrafine Carbon Tubes in Nanochannels of an Anodic Aluminum Oxide Film," 8 *Chem. Mater.* 2109–2113 (1996).

Sumio Iijima, "Helical Microtubules of Graphic Carbon," 354 *Nature* 56–58 (1991).

T.W. Ebbesen et al., "Large–Scale Synthesis of Carbon Nanotubes," 358 *Nature* 220–222 (1992).

Walt A. deHeer et al., "Aligned Carbon Nanotube Films: Production and Optical and Electronic Properties," 268 *Science* 845–847 (1995).

T. Guo et al., "Catalytic Growth of Single–Walled Nanotubes by Laser Vaporization," 243 *Chem. Phys. Lett.* 49–54 (1995).

A.G. Rinzler et al., "Unraveling Nanotubes: Field Emission from an Atomic Wire," 269 *Science* 1550–1553 (1995).

Walter A. deHeer et al., "A Carbon Nanotube Field–Emission Electron Source," 270 *Science* 1179–1180 (1995).

Andreas Thess et al., "Crystalline Ropes of Metallic Carbon Nanotubes," 273 *Science* 483–487 (1996).

Hongjie Dai et al., "Single–Wall Nanotubes Produced by Metal–Catalyzed Disproportionation of Carbon Monoxide," 260 *Chem. Phys. Lett.* 474–475 (1996).

Hongjie Dai et al., "Nanotubes as Nanoprobes in Scanning Probe Microscopy," 384 *Nature* 147–150 (1996).

A.C. Dillon et al., "Storage of Hydrogen in Single–Walled Carbon Nanotubes," 386 *Nature* 377–379 (1997).

English Translation of JP 8–115652 (May 7, 1996).

* cited by examiner

STRUCTURE AND A PROCESS FOR ITS PRODUCTION

This application is a division of application Ser. No. 09/178,422, filed Oct. 26, 1998 now U.S. Pat. No. 6,525, 461.

BACKGROUND OF THE INVENTION

1. Field of the Invention

The present invention relates to a narrow titanium-containing wire, a production process thereof, a nanostructure and an electron-emitting device, and more particularly to a narrow wire that can be widely used as a functional material or structural material for electron devices, microdevices and the like. In particular, it can be used as a functional material for photoelectric transducers, photo-catalytic devices, electron-emitting materials, narrow wires for micromachines, narrow wires for quantum effect devices, and the like, a production process thereof, a nanostructure comprising the narrow wire, and an electron-emitting device using the nanostructure.

2. Related Background Art

Titanium and alloys thereof have heretofore been widely used as structural materials for aircraft, automobile, chemical equipment and the like because they are light-weight, strong and hard to corrode. Besides, titanium and alloys thereof are also in use as medical materials because they are harmless to human bodies.

Recently, in research related solar cells, decomposition of injurious materials, antibacterial action, etc., extensive use had been made of the photo-conductive properties, photo-catalytic activity and the like of titanium oxide.

Besides, the application range of titanium materials extends to many fields such as vacuum getter materials, electron-emitting materials, metallic alloys for hydrogen storage and electrodes for various electron devices.

On the other hand, thin films, narrow wires, small dots and the like of metals and semiconductors may exhibit specific electrical, optical and/or chemical properties in some cases because the movement of electrons is restricted to certain shorter characteristic lengths.

From this point of view, an interest in materials (nanostructures) having a structure smaller than 100 nm as functional materials is greatly increasing.

An example of a method for producing a nanostructure includes a production by semiconductor processing techniques including minute pattern writing techniques such as photolithography, electron beam exposure and x-ray diffraction exposure.

Aside from such a production method, it has been attempted to realize a novel nanostructure on the basis of a naturally formed regular structure, i.e., self-ordered structure. Since this technique leads to a possibility of producing a fine and special structure superior to those made by the conventional methods, many researchers are beginning to use it.

An example of the specific self-ordered nanostructure is an anodically oxidized aluminum film [see, for example, R. C. Furneaux, W. R. Rigby & A. P. Davidson, NATURE Vol. 337, p. 147 (1989)]. This anodically oxidized aluminum film (hereinafter called "porous alumina") is formed by anodically oxidizing an Al plate in an acid electrolyte. As illustrated in FIG. 6, its feature resides in that it has a specific geometric structure that narrow cylindrical pores (nanoholes) 14, as extremely fine as several nanometers to several hundred nanometers in diameter, are arranged at intervals of several nanometers to several hundred nanometers parallel to each other. These narrow cylindrical pores 14 have a high aspect ratio and are excellent in linearity and uniformity of sectional diameter.

Various applications are being attempted by using the specific geometric structure of such a porous alumina as a base. The detailed explanation thereof is found in Masuda [Masuda, KOTAI-BUTSURI(Solid-State Physics), 31, 493, 1996]. Techniques for filling a metal or semiconductor into narrow pores and techniques for taking a replica are typical, and various applications including coloring, magnetic recording media, EL light-emitting devices, electrochromic devices, optical devices, solar cells and gas sensors have been attempted.

Further, applications to many fields, for example quantum effect devices such as quantum wires and MIM (metal-insulator-metal) tunnel effect devices, and molecular sensors using nanoholes as chemical reaction sites, are expected.

If such a nanostructure made with a highly functional material, i.e., titanium, is available, the nanostructure is expected to be utilized as a functional structure such as electron devices, microdevices, etc.

As an example where a nanostructure is produced by using a titanium material and controlling size and form, patterning of a thin film of the titanium material by semiconductor processing techniques including minute pattern writing techniques such as photolithography, electron beam exposure and x-ray diffraction exposure as described above may be mentioned. However, these techniques involve problems of poor yield and high cost of apparatus, and there is thus a demand for development of a simple method for producing a nanostructure with good reproducibility.

The method using the self-ordering phenomenon, particularly the method using the porous alumina as a base, is preferable to the method using a semiconductor processing technique because a nanostructure can be easily produced over a large area under good control.

As an example where a titanium-containing nanostructure was produced by applying such a method, an example by Masuda et al., in which porous $TiO_2$ was formed by taking a replica of porous alumina with titanium oxide [Jpn. J. Appl. Phys., 31 L1775 -LI777(1992); and J. of Materials Sci. Lett., 15, 1228–1230(1996)] may be mentioned.

However, this method still has problems to be solved, such as it must go through many complicated steps in the process of taking the replica, and the crystallinity of $TiO_2$ is poor since it is formed by electrodeposition.

On the other hand, it is often conducted to filling a metal or semiconductor into narrow pores of the porous alumina, thereby producing a nanostructure. Examples thereof include filling of Ni, Fe, Co. Cd or the like by an electrochemical method [see D. Al-Mawlawi et al., Mater. Res., 9,1014(1994); and Masuda et al., Hyomen-Gijutsu (Surface Techniques), Vol. 43, 798(1992)], and melt introduction of In, Sn, Se, Te or the like [see C. A. Huber et al., SCIENCE, 263, 800(1994)]. However, the filling of a Ti-containing material according to either method has not been reported for the reasons that the electrodeposition of Ti is not common, and that the Ti materials generally have a high melting point.

On the other hand, potassium titanate whiskers of the submicron size (0.2to 1.0 $\mu$m in diameter, 5 to 60 $\mu$m in length) have been developed as applications to fiber reinforced plastics, fiber reinforced metals and fiber reinforced ceramics [Nikon-Kinzoku-Gakkai-ski (Journal of The Japan Institute of Metals), 58, 69–77(1994)]. However, these materials are all powdery, and no technique for position-controlling and arranging them on a substrate is yet known. In order to expect specific electrical, optical and chemical properties as nanostructures, it is also necessary to further narrow the pores.

SUMMARY OF THE INVENTION

The present invention has been made in view of such various technical requirements as described above, and it is an object of the present invention to provide a process for producing a narrow titanium-containing wire using titanium as a main material, particularly, a process for producing a narrow titanium-containing wire on a substrate.

Another object of the present invention is to provide a nanostructure with narrow titanium-containing wires having a specific direction and a uniform diameter arranged at regular intervals on a substrate.

A further object of the present invention is to provide a high-performance electron-emitting device capable of emitting electrons in a greater amount.

The above objects can be achieved by the present invention described below.

According to the present invention, there is thus provided a process for producing a narrow titanium-containing wire, comprising steps of:

(i) providing a structure comprising a substrate having a titanium-containing surface and a porous layer containing narrow pores extending towards the surface; and (ii) forming narrow titanium-containing wires in the respective narrow pores by heat treatment of the structure obtained in the step (i).

According to the present invention, there is also provided a nanostructure comprising a substrate having a surface containing titanium and narrow titanium-containing wires on the surface, with the narrow titanium-containing wires extending in the direction substantially vertical to the surface.

According to the present invention, there is further provided a narrow wire produced in accordance with the production process described above.

According to the present invention, there is still further provided an electron-emitting device comprising a structure including a substrate having a titanium-containing surface, a porous layer containing narrow pores extending towards the surface, and narrow titanium-containing wires respectively formed in the narrow pores; a counter electrode arranged in an opposing relation to the titanium-containing surface; and a means for applying a potential between the titanium-containing surface and the counter electrode.

According to the embodiment of the present invention, there can be produced a narrow titanium-containing wire and a titanium-containing nanostructure on a nanometer scale.

The nanostructure provided with the narrow titanium-containing wires according to the embodiment of the present invention can be widely applied as a functional material or structural material for various kinds of electron devices and microdevices, including photoelectric transducers, photocatalysts, quantum wires, MIM devices, electron-emitting devices and vacuum getter materials.

The narrow titanium-containing wires according to the embodiment of the present invention can also be used as a reinforcement for plastics and the like.

BRIEF DESCRIPTION OF THE DRAWINGS

FIG. 1A illustrates the form like a strand, FIG. 1B illustrates the form like a column, FIG. 1C illustrates the form like a column the diameter of which successively varies, and FIG. 1D illustrates the form with a plurality of columns united.

FIG. 2A illustrates a step of providing a substrate with a titanium-containing film formed on a base, FIG. 2B illustrates a step of forming an Al-containing film on the substrate, FIG. 2C illustrates a step of anodizing the Al-containing film to form a porous alumina, and FIG. 2D illustrates a step of forming narrow titanium-containing wires in the respective narrow pores of the porous alumina.

FIG. 3A illustrates a nanostructure provided with the narrow titanium-containing wires arranged in the direction substantially vertical to a substrate, and FIGS. 3B, 3C and 3D illustrate nanostructures provided with the narrow titanium-containing wires arranged in narrow pores of porous alumina.

DESCRIPTION OF THE PREFERRED EMBODIMENTS.

The embodiments of the present invention will be hereinafter specifically described.

Constitution of a Narrow Titanium-Containing Wire and a Nanostructure to Which the Narrow Titanium-Containing Wire is Applied According to the present invention, the narrow titanium-containing wire and the nanostructure to which the narrow titanium-containing wire is applied are produced by forming a porous layer having narrow pores on a substrate having a titanium-containing surface and forming narrow titanium-containing wires in the respective narrow pores by carrying out a heat treatment under a specific atmosphere.

Figure 3A:
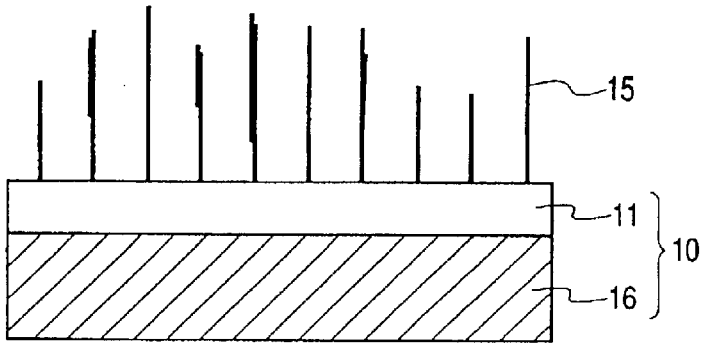
FIGS. 3A, 3B, 3C and 3D conceptually illustrate examples of a nanostructure to which the narrow titanium-containing wire according to the present invention is applied, where
Figure 3B:
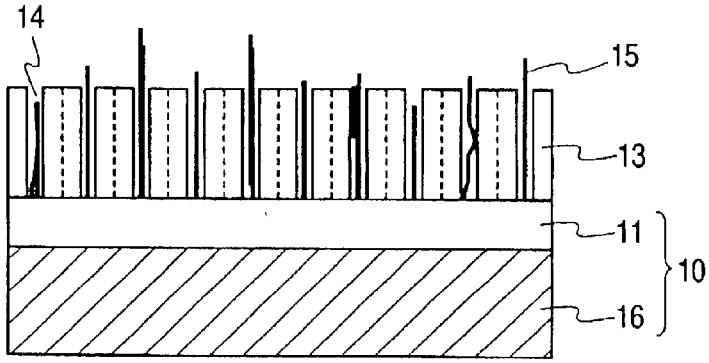

FIGS. 3A, 3B, 3C and 3D conceptually illustrate examples of the nanostructure provided with the narrow titanium-containing wire. FIG. 3A illustrates a nanostructure composed of a substrate 10 having a layer 11, which constitutes a titanium-containing surface formed thereon, and the narrow titanium-containing wires 15 arranged in a specific direction (the substantially vertical direction) to the surface. FIG. 3B illustrates a nanostructure composed of a substrate 10 having a layer 11, which constitutes a titanium-containing surface formed thereon, a porous layer (porous alumina) 13 provided on the surface that has narrow pores 14 extending vertically to the surface, and the narrow titanium-containing wires 15 being arranged in the respective narrow pores 14.

The narrow titanium-containing wires 15 are formed of a metal, semiconductor or insulator comprising titanium as a main component, for example, any of titanium, titanium alloys, including titanium-iron and titanium-aluminum, and optional titanium compounds such as titanium oxide, titanium hydride, titanium nitride and titanium carbide. The diameter (thickness) of the narrow titanium-containing wire 15 is generally within a range of from 1 nm to 2 μm, and the length thereof is generally within a range of from 10 nm to 100 μm. Since the form of the narrow titanium-containing wire 15 is influenced by the form of the narrow pore of the porous layer to some extent, the pore diameter of the porous layer, an interval between the narrow pores, and the like are geometrically controlled, whereby the diameter and the like of the narrow titanium-containing wire can be controlled to some extent, and the growing direction of the narrow wire can also be controlled so as to extend, for example, vertically to the surface of the substrate.

Further, the narrow titanium-containing wire can be provided as whisker crystal under special production conditions. Such conditions will be described subsequently.

As the porous layer formed on the titanium-containing surface at the structure illustrated in FIG. 3B, porous alumina, zeolite, or porous silicon may be used. A mask is formed by a photolithographic method, or the like. In particular, porous alumina is desirable because it has linear narrow pores at regular intervals, so that narrow titanium-containing wires excellent in linearity can be formed at regular intervals. Thus, a nanostructure provided with the narrow titanium-containing wires 15 arranged at regular intervals in a specific direction (for example, the substantially vertical direction to the surface of the substrate) can be provided.

Figure 6:
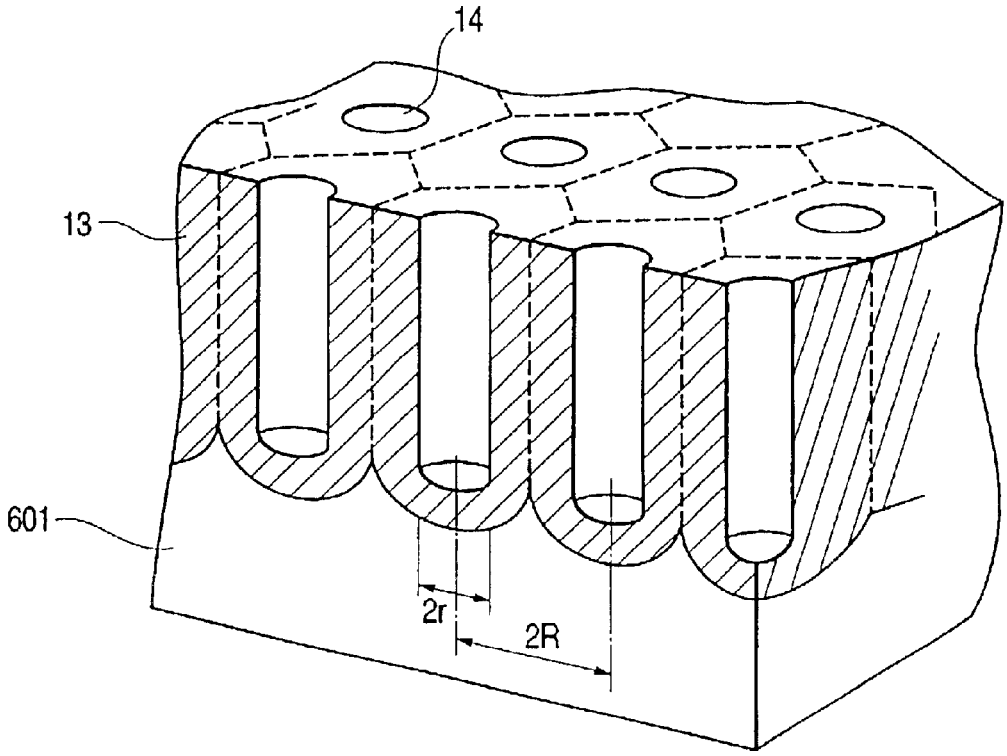
FIG. 6 conceptually illustrates porous alumina.

The structure of the porous alumina is illustrated in FIG. 6. The porous alumina 13 is composed mainly of Al and O, and many cylindrical and linear narrow pores 14 thereof are arranged substantially vertically to the surface of an aluminum film (plate) 601. The respective narrow pores are arranged at substantially regular intervals parallel to each other. The narrow pores tend to be arranged in the form of a triangular lattice, as illustrated in FIG. 6. The diameter 2r of the narrow pore is about 5 nm to 500 nm and the interval 2R between the narrow pores is about 10 nm to 500 nm. The pore diameter and interval may be controlled to some extent by various process conditions such as the concentration and temperature of an electrolyte used in anodization, a method of applying anodizing voltage, anodizing voltage and time, and conditions of a subsequent pore widening treatment. In other words, the pore diameter and interval can be controlled, thereby controlling the diameter (thickness) of the narrow titanium-containing wire to a certain degree within the above range, for example, to 300 nm or less.

In the nanostructure illustrated in, FIG. 3B, the narrow titanium-containing wire 15 projects from the surface of the narrow pore. However, as illustrated in FIG. 3C, the growth of the narrow wire may also be stopped on the interior of the narrow pore to utilize it.

Figure 3C:
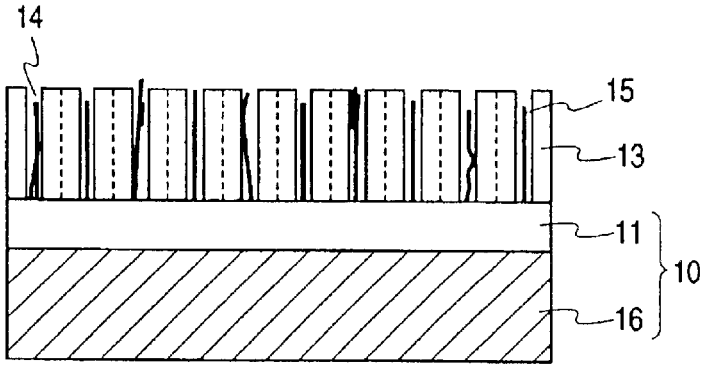
Figure 3D:
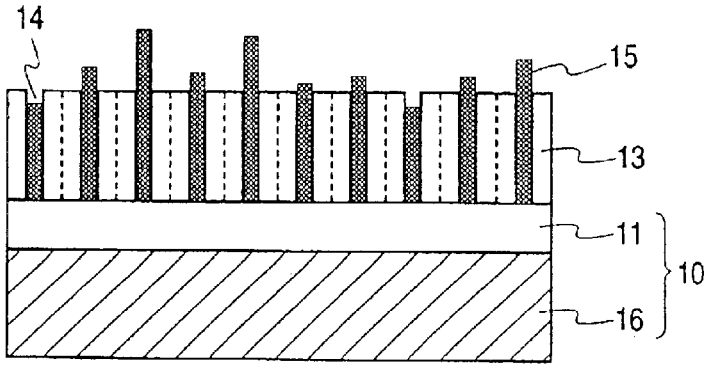

In FIGS. 3B and 3C, the diameter of titanium-containing wire 15 is smaller than the diameter of the narrow pore 14 of anodic porous alumina. On the other hand, as illustrated in FIG. 3D, the diameter of titanium-containing wire 15 may be the same as the diameter of the narrow pore 14.

Production Process of the Narrow Titanium-Containing Wire and the Nanostructure to Which the Narrow Titanium-Containing Wire is Applied The narrow titanium-containing wire and the nanostructure to which the narrow titanium-containing wire is applied are preferably produced by providing a structure comprising a substrate having a titanium-containing surface and a porous layer containing narrow pores (Step 1) and forming narrow titanium-containing wires in the respective narrow pores by carrying out a heat treatment of the structure (Step 2).

The production process of the narrow titanium-containing wire and the nanostructure to which the narrow titanium-containing wire is applied will hereinafter be described in order with reference to FIGS. 2A to 2D.

In FIGS. 2A to 2D, reference numeral 10 indicates a substrate, 15 is a narrow titanium-containing wire, 11 is a titanium-containing film, 12 is an aluminum-containing film, 13 is a porous layer (porous alumina), 14 is a narrow pore (nanohole), and 15 is a narrow titanium-containing wire.

Step 1

Provision of the Structure Provided with the Porous Layer Containing Narrow Pores on the Substrate 10

Figure 2A:
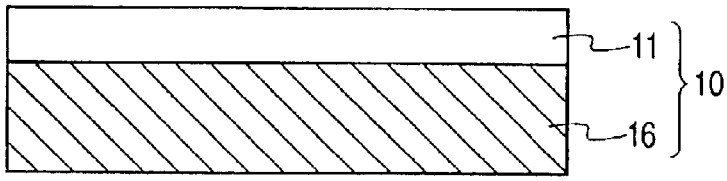
FIGS. 2A, 2B, 2C and 2D are conceptual cross-sectional views illustrating a production process of a nanostructure according to an embodiment of the present invention, where

No particular limitation is imposed on the substrate 10 having the titanium-containing surface, so long as it contains titanium on the surface. Examples thereof include plates of titanium or an alloy thereof and substrates composed of any of various kinds of bases 16 such as quartz glaze and Si and a Ti-containing film 11 formed on the base, as illustrated in FIG. 2A.

The Ti-containing film 11 can be formed by one of optional film forming methods including resistance heating deposition, EB deposition, sputtering, CVD and plating.

The porous layer is preferably porous alumina that can be formed by an easy production process. The narrow pores of this layer are linear and high in aspect ratio. A process for forming the porous alumina as a porous layer will hereinafter be described.

Step 1a

Formation of the Al-Containing Film on the Substrate

Figure 2B:
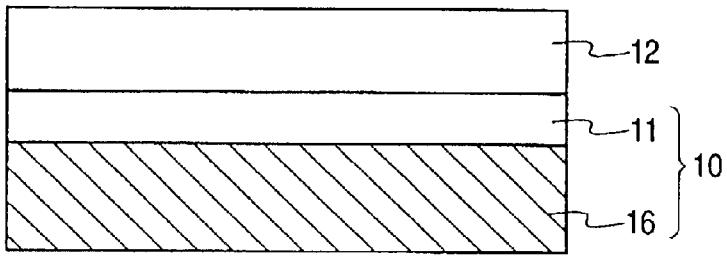

The Al-containing film 12 illustrated in FIG. 2B can be formed by one of optional film forming methods including resistance heating deposition, EB deposition, sputtering, CVD and plating.

Step 1b

Anodizing Step

Figure 2C:
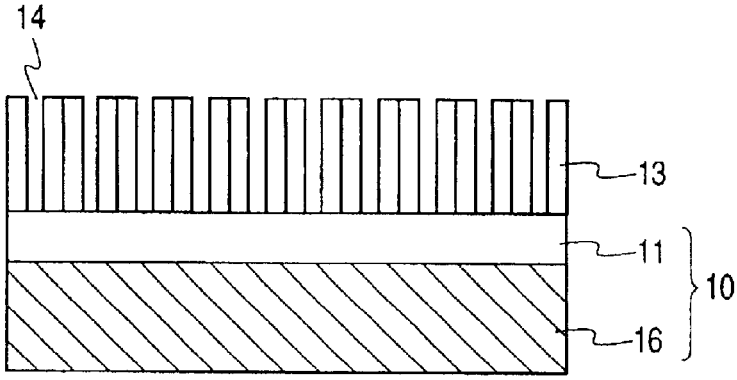

The Al-containing film 12 is subsequently anodized, thereby forming porous alumina 13 on the substrate (see FIG. 2C). The outline of an anodizing apparatus usable in this step is illustrated in FIG. 5.

Figure 5:
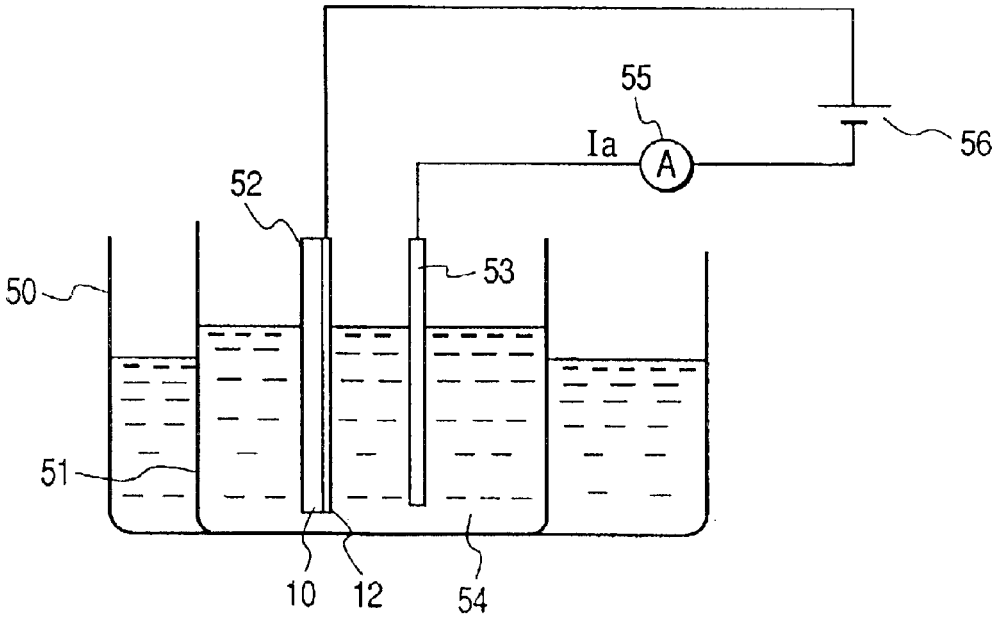
FIG. 5 conceptually illustrates the outline of an anodizing apparatus.

In FIG. 5, reference numeral 50 indicates a thermostatic bath, 51 is a reaction vessel, 52 is a sample with an Al-containing film 12 formed on a substrate 10 having a Ti-containing surface; 53 is a Pt cathode, 54 is an electrolyte, 56 is a power source for applying anodizing voltage, and 55 is an ammeter for measuring an anodizing current (Ia). Besides, a computer (not illustrated) for automatically controlling and measuring the voltage and current and the like is incorporated. The sample 52 and the cathode 53 are arranged in the electrolyte 54 the temperature of which is kept constant by the thermostatic bath 50. Voltage is applied between the sample 52 and the cathode 53 from the power source 56 to conduct the anodization.

Examples of the electrolyte used in the anodization include solutions of oxalic acid, phosphoric acid, sulfuric acid and chromic acid. Various conditions such as anodizing voltage and temperature may be suitably set according to a nanostructure to be produced.

In the anodizing step, the Al-containing film 12 is anodized over the entire film thickness. The anodization proceeds from the surface of the Al-containing film. When the anodization reaches the surface of the substrate 10, a change in the anodizing current is observed. Therefore, this change can be detected to judge whether the anodization is completed. For example, when a substrate with a Ti-containing film provided on an optional base is used, whether the application of the anodizing voltage is completed can be judged by a reduction in the anodizing current. After the anodizing treatment, the pore diameter of narrow pores can be suitably widened by a pore-widening treatment in which the treated substrate is immersed in an acid solution (for example, a phosphoric acid solution). The pore diameter can be controlled by the concentration of the solution, treating time and temperature.

Step 2

Figure 2D:
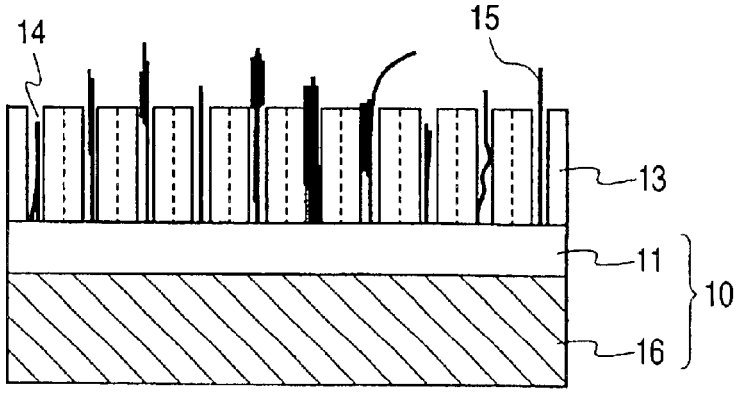

Formation of the Narrow Titanium-Containing Wires in the Narrow Pores by a Heat Treatment The structure having the titanium-containing surface, on which the porous layer has been formed, is placed in a reaction vessel and subjected to a heat treatment under a specific atmosphere, whereby titanium present at the bottom of the narrow pores can be reacted with the atmosphere to form narrow titanium-containing wires 15, which are a reaction product of titanium and the atmosphere in the respective narrow pores of the porous layer (see FIG. 2D).

Figure 4:
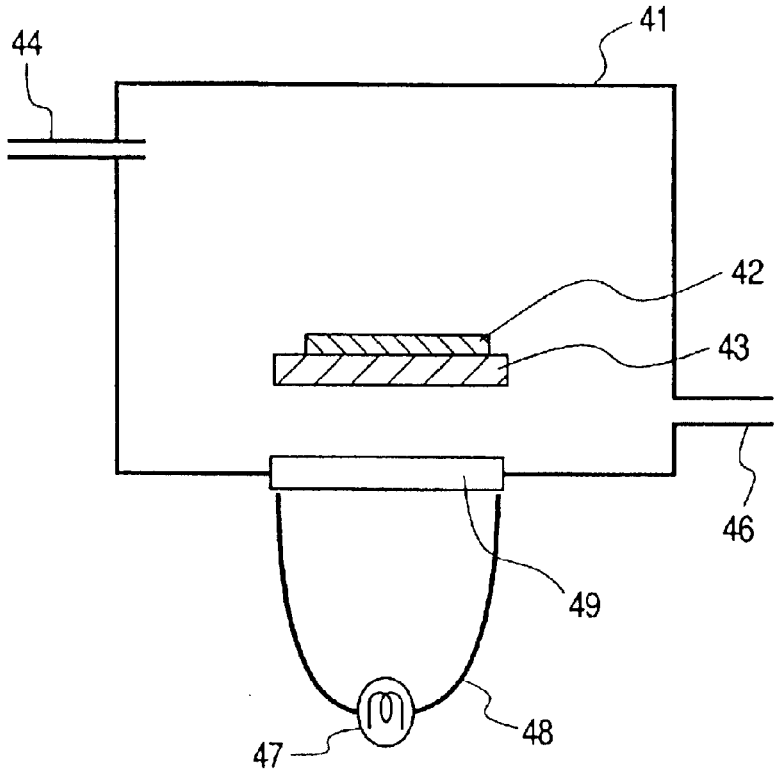
FIG. 4 conceptually illustrates the outline of a reactor for heat treatment used in the formation of narrow titanium-containing wires.

The reactor for conducting the heat treatment is described with reference to FIG. 4. In FIG. 4, reference numeral 41 indicates a reaction vessel, 42 is a sample (substrate), and 43 is an infrared absorbing plate, which acts as a sample holder. Reference numeral 44 designates a pipe for introducing a gas such as hydrogen or oxygen, which is preferably arranged in such a manner that the concentration of the gas becomes uniform in the vicinity of the substrate. Reference numeral 46 indicates a gas discharging line connected to a turbo-molecular pump or rotary pump. Reference numeral 47 designates an infrared lamp for heating the base, and 48 is a condenser mirror for focusing infrared rays with good efficiency to the infrared absorbing plate. Reference numeral 49 is a window capable of transmitting the infrared rays. Besides, a vacuum gauge for monitoring the pressure within the reaction vessel and a thermocouple for measuring the temperature of the substrate (both, not illustrated) are incorporated. It goes without saying that besides the above-described apparatus, an electric furnace type apparatus, which heats the whole structure from the outside, may also be used without any particular problem.

The atmosphere and temperature used in the heat treatment are suitably set according to the material and form of a narrow titanium-containing wire to be produced. For example, when hydrogen, oxygen, nitrogen or a hydrocarbon is introduced as the atmosphere, a narrow wire correspondingly composed of titanium hydride, titanium oxide, titanium nitride or titanium carbide can be produced. Besides, materials used in the chemical vapor phase epitaxy, such as $SiH_4$, $B_2H_5$, $PH_3$, $Al(C_2H_5)_3$ and $Fe(CO)_5$, may also be used to form narrow wires containing titanium compounds, such as titanium silicide, titanium boride, titanium phosphide, aluminum-titanium alloy and iron-titanium alloy, respectively. In particular, when a narrow wire composed of titanium oxide is produced, the heat treatment is conducted at a temperature ranging from 500° C. to 900° C. under an atmosphere containing at least 1 Pa of water vapor, whereby a narrow wire in the form of a whisker can be formed. At this time, it is preferred that hydrogen is mixed into the atmosphere because the growth of the wire is accelerated. In general, a whisker is a crystal grown in the form of a needle and is scarcely dislocated, and techniques such as deposition from a solution, decomposition of a compound and reduction of, for example, a halide with hydrogen have been known as the production methods thereof The titanium oxide whisker according to the present invention is considered to be grown by an oxidation reaction with the water vapor and a reduction reaction with hydrogen (or heat).

Such a narrow titanium oxide wire having excellent crystallinity can be expected to have good electrical properties and electron-emitting properties as a semiconductor.

According to the process described above; the nanostructure illustrated in FIG. 3B, in which the narrow titanium-containing wires are present in the respective narrow pores of the porous layer, the narrow pores extending vertically to the Ti-containing surface, can be formed.

The porous layer 13, having the narrow pores in which the narrow wires are present, of the structure thus obtained is removed by etching, thereby obtaining a nanostructure provided with the narrow Ti-containing wires on the Ti-containing surface of the substrate, the narrow wires extending vertically to the surface as illustrated in FIG. 3A.

Only the narrow wires are separated from the nanostructure illustrated in FIG. 3A or 3B, whereby narrow wires having an extremely fine and even thickness and excellent linearity can be obtained.

Figure 7:
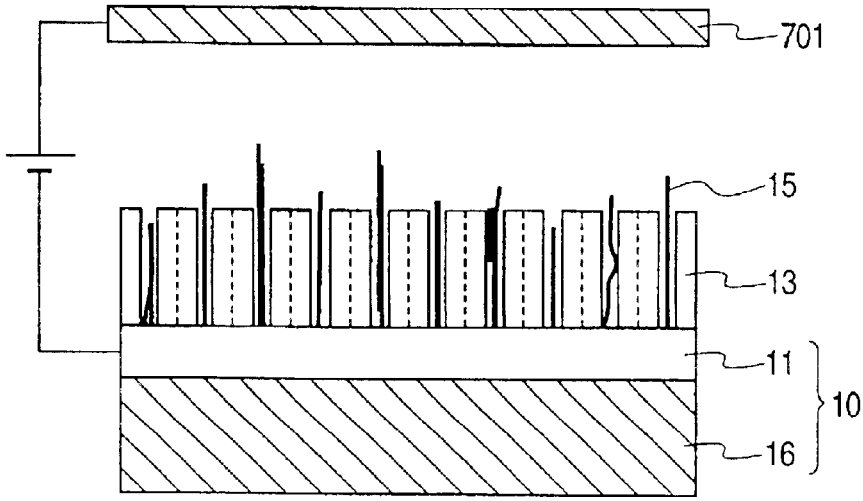
FIG. 7 is a schematic cross-sectional view illustrating an electron-emitting device according to an embodiment of the present invention.

The nanostructure obtained in the above-described manner can also be made into an electron-emitting device by arranging a counter electrode 701 opposite to the titanium-containing surface 11 in a vacuum, as illustrated in FIG. 7, and constructing in such a manner that a potential may be applied between the titanium-containing surface 11 and the counter electrode 701. Since most of the narrow wires in the nanostructure used in this device extend in the direction substantially vertical to the surface, the device can be expected to emit electrons efficiently and stably.

The present invention will, hereinafter be described in detail by the following Examples with reference to the drawings. However, the present invention is not limited to these examples.

EXAMPLE 1

This example describes the production of narrow titanium oxide wires and a nanostructure provided with the narrow titanium oxide wires.

The production process of the narrow titanium-containing wire and the nanostructure, to which the narrow wire is applied, according to the present invention is described in order with reference to FIGS. 2A to 2D.

Step 1

In this example, a quartz base was used as a base 16. After the base was thoroughly washed with an organic solvent and purified water, a Ti film 11 having a thickness of 1 $\mu$m was formed on the base by sputtering to provide a substrate 10 (see FIG. 2A).

Step 1a

An A film having a thickness of 1 $\mu$m was further formed as an Al-containing film 12 on the substrate 10 by sputtering (see FIG. 2B).

Step 1b

The Al-containing film 12 was subsequently subjected to an anodizing treatment using an anodizing apparatus illustrated in FIG. 5 (see FIG. 2C). A 0.3 M oxalic acid was used as an acid electrolyte and kept at 17° C. in a thermostatic bath. Anodizing voltage and treating time were set to DC 40 V and 10 minutes, respectively. In the course of the anodization process, i.e., after about 8 minutes, the anodization reached the surface (Ti film) of the substrate, and so reduction in the anodizing current was observed.

After the anodizing treatment, the diameter of narrow pores of the porous layer thus obtained was controlled by immersing the treated substrate in a 5 wt % phosphoric acid solution for 45 minutes as a pore-widening treatment. After the treatment, the substrate was washed with purified water and isopropyl alcohol.

Step 2

Heat Treating Step

The structure on the substrate on which the porous alumina had been formed was subsequently subjected to a heat treatment in a mixed atmosphere of water vapor, hydrogen and helium in accordance with the following process, thereby forming narrow titanium oxide wires. Namely, the structure was placed in a reaction vessel illustrated in FIG. 4. Hydrogen gas diluted to 1/50 with helium, passed through purified water kept at 5° C. with bubbling, was introduced at a flow rate of 50 sccm through a gas introducing pipe 44, while keeping the pressure within the reaction vessel at 1,000 Pa. An infrared lamp was then lit to heat the structure at 700° C. for 1 hour, thereby heat-eating the structure. After the infrared lamp was turned off, and the temperature of the structure was returned to room temperature, the feed of the gas was stopped to take the structure out in the air.

Evaluation

Observation of the Structure

The surface and section of the structure taken out were observed through an FE-SEM (field emission-scanning electron microscope).

Result

As illustrated in FIG. 3B, the porous alumina was formed with narrow pores having a diameter of about 60 nm and extending vertically to the surface of the Ti-containing film 11, the narrow pores being arranged at substantially regular intervals of about 100 nm parallel to each other, and a large number of narrow wires grew within the respective narrow pores and from the interior of the narrow pores toward the outside. Each narrow titanium-containing wire grew from the surface of the substrate in the direction substantially vertical to the surface in accordance with the shape of the narrow pore, and had a diameter of about 40 to 60 nm and a length of several hundreds nanometers to several micrometers.

Further, the narrow wire was identified as being composed mainly of titanium by EDAX (energy non-dispersive x-ray diffraction analyzer). The x-ray diffraction of the narrow wire revealed that rutile type titanium oxide was present.

Figure 1A:
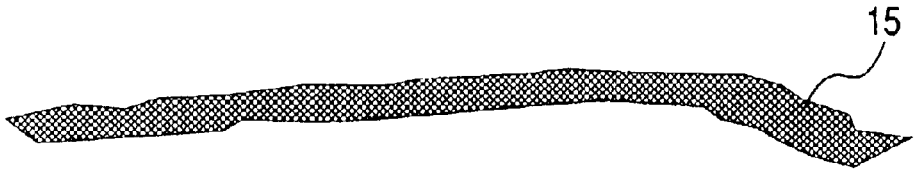
FIGS. 1A, 1B, 1C and 1D conceptually illustrate examples of the form of a narrow titanium-containing wire according to the present invention, where
Figure 1B:
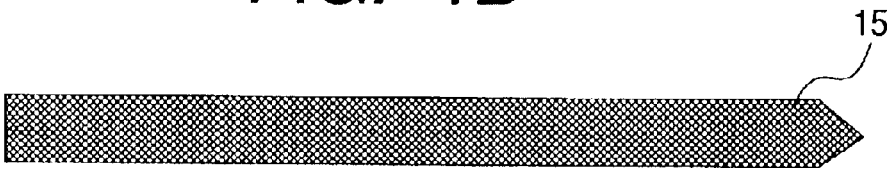
Figure 1C:
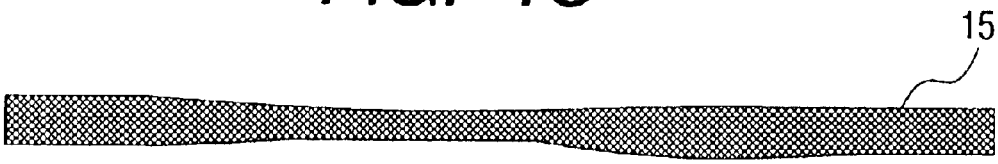
Figure 1D:
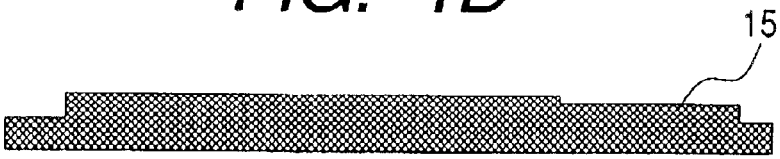

When the narrow titanium-containing wires formed in the narrow pores were separated from the substrate to observe them through a microscope at a high magnification, those in the form of a strand as illustrated in FIG. 1A, those in the form of a column as illustrated in FIG. 1B, those in the form of a column the thickness of which successively varied as illustrated in FIG. 1C, and those in the form with a plurality of columns united as illustrated in FIG. 1D were observed. Among those illustrated in FIGS. 1B, 1C and 1D, those having an edge form corresponding to crystal face were included. They were considered to have undergone crystal growth, i.e., whisker growth.

EXAMPLE 2

This example describes control of the diameter of a narrow titanium-containing wire by controlling the pore diameter of porous alumina.

Structures having porous alumina with the pore diameter thereof varied were provided in the same manner as in Example 1, except that the anodizing voltage was set to 50 V, and the pore-widening treatment was conducted for varied periods of 0 minutes, 15 minutes, 30 minutes, 45 minutes and 60 minutes. The typical pore diameters of the structures were 10 nm, 25 nm, 40 nm, 60 nm and 80 nm, respectively. These structures were then subjected to a heat treatment. The heat treatment step was conducted in accordance with the step in Example 1.

As a result, the diameters of narrow titanium-containing wires formed in the narrow pores of the respective structures were influenced by the respective pore diameters, and so the structure having a greater pore diameter tended to have narrow wires having a greater diameter. Namely, each narrow titanium-containing wire was influenced by the form of the narrow pore to grow. Specifically, the average diameters of the respective narrow titanium-containing wires were 8 nm, 20 nm, 30 nm, 50 nm and 70 nm, respectively.

EXAMPLE 3

This example describes control of the length of a narrow titanium-containing wire by controlling the conditions of a heat treatment.

Five structures having porous alumina on their substrates were provided in the same manner as in Example 1, except that the pore-widening treatment was conducted for 45 minutes. These structures were heat-treated in the same manner as in Example 1, except that the temperature of the heat treatment was varied to 600° C., 650° C., 700° C., 750° C. and 800° C., respectively.

The nanostructures thus obtained were observed in the same manner as in Example 1. As a result, the observation by the FE-SEM revealed that in the nanostructure obtained by the heat treatment at 600° C., the growth of many narrow titanium-containing wires stopped midway in the narrow pore, as illustrated in FIG. 3C. As the temperature of the heat treatment was raised, the narrow titanium-containing wire tended to become longer. The heat treatment at 700° C. resulted in finding a number of narrow titanium-containing wires projected from the tops of the narrow pores, as illustrated in FIG. 3B. In the heat treatment at 800° C., the diameters of titanium-containing wires were about 60 nm, the same as the diameters of the narrow pores, as illustrated in FIG. 3D.

EXAMPLE 4

This example describes the formation of a nanostructure illustrated in FIG. 3A.

In this example, a nanostructure illustrated in FIG. 3B was produced in the same manner as in Example 1, and the porous alumina 13 thereof was then removed by etching with phosphoric acid.

In the nanostructure according to this example, as illustrated in FIG. 3A, narrow titanium-containing wires having a diameter of about 40 to 60 nm grew at intervals of about 100 nm from the surface of the substrate in the direction substantially vertical to the surface.

EXAMPLE 5

This example describes the production of a narrow titanium oxide wire and a nanostructure provided with the narrow titanium oxide wire. This example followed Example 1, except for Step 2.

In Step 2 of this example, oxygen gas was introduced at a flow rate of 10 sccm into the reaction vessel while keeping the pressure within the reaction vessel at 100 Pa. The structure was heated at 500° C. for 1 hour, thereby heat-treating the structure.

Such narrow wires and nanostructure, as illustrated in FIG. 3B, were confirmed by FE-SEM. Further, the x-ray diffraction of the narrow wire revealed that anatase type titanium oxide was present.

The nanostructure according to this example was placed in an aqueous methanol solution (methanol:water=1:6) and the whole light exposure by a high pressure mercury lamp was conducted. As a result, hydrogen was detected, and so it was confirmed that the nanostructure according to this example has a photocatalytic activity.

EXAMPLE 6

This example describes the production of a narrow titanium carbide wire and a nanostructure provided with the narrow titanium carbide wire. This example followed Example 1, except for Step 2.

In Step 2 of this example, ethylene gas was introduced at a flow rate of 50 sccm into the reaction vessel while keeping the pressure within the reaction vessel at 1,000 Pa. The structure was heated at 900° C. for 1 hour, thereby heat-treating the structure.

Such narrow wires and nanostructure, as illustrated in FIG. 3B, were confirmed by FE-SEM. Further, the x-ray diffraction of the narrow wire revealed that titanium carbide was present.

The nanostructure according to this example and an anode have a fluorescent substance were arranged opposite each other at an interval of 1 mm in a vacuum device, and voltage of 1 kV was applied between the substrate and the anode. As a result, an electron emission current was observed together with emission of fluorescence from the fluorescent substance. This proved that the nanostructure according to this example could function as a good electron emitter.

As described above, the respective embodiments of the present invention can bring about, for example, the following effects.

(1) A narrow titanium-containing wire having a diameter of several tens nanometers to several hundred nanometers can be produced with ease.

(2) A narrow titanium-containing wire having excellent linearity can be produced. In particular, a titanium oxide whisker having excellent crystallinity can be obtained.

(3) A nanostructure comprising titanium as a main material can be obtained.

(4) A nanostructure provided with narrow titanium-containing wires having a specific directional property and a uniform diameter arranged at regular intervals on a substrate can be obtained.

(5) A high-performance electron-emitting device capable of emitting electrons in a greater amount can be obtained.

What is claimed is:

1. A process for producing a structure comprising steps of:

(i) providing a substrate having a surface consisting essentially of at least one of titanium and a titanium alloy and a porous layer containing narrow pores extending toward the surface; and (ii) growing wires from a portion of the substrate in the respective pores by heat treatment of the structure obtained in step (i).

2. The process according to claim 1, wherein the step (i) comprises sub-steps of:

(a) forming an aluminum-containing film on the substrate; and (b) anodically oxidizing the aluminum-containing film to form the porous layer.

3. The process according to claim 1, wherein the step (ii) comprises a sub-step of conducting the heat treatment of the structure at a temperatures ranging from 500° C. to 900° C. under an atmosphere containing water vapor of at least 1 Pa.

4. The process according to claim 1, wherein the step (ii) comprises a sub-step of conducting the heat treatment of the structure at a temperature ranging from 500° C. to 900° C. under an atmosphere containing water vapor of at least 1 Pa and hydrogen.

5. The process according to claim 1, wherein said pores reach said surface.

6. The process according to claim 1, wherein said heat treatment is conducted under a gas atmosphere containing a gas selected from the group consisting of hydrogen, oxygen, nitrogen, a hydrocarbon, $SiH_4$, $B_2H_5$, $PH_3$, $Al(C_2H_5)_3$ and $Fe(CO)_5$.

7. The process according to claim 6, wherein said wires are formed by a reaction of said surface with the gas of said gas atmosphere.

8. The process according to claim 1, wherein a diameter of said wires is less than a diameter of said pores.

9. The process according to claim 1, further comprising a step of removing said porous layer after the step (ii).

10. The process according to claim 1, further comprising a step of separating only said wires from said structure after the step (ii).

11. A process for producing a device having an electrode comprising the steps of:

i) providing a member having a porous region obtained by anodic oxidation; and ii) growing wires from a portion of the substrate comprising titanium or a titanium alloy in respective pores of the porous region by a heat treatment under an atmosphere containing a hydrocarbon, wherein a layer with which voltage can be applied between the layer and said electrode is provided under the porous region of said member.

12. The process according to claim 11, wherein said heat treatment is conducted at a temperature ranging from 500° C. to 900° C.

13. The process according to claim 11, wherein a diameter of a pore is from 5 nm to 500 nm.

14. The process according to claim 11, wherein the porous region is formed by anodically oxidizing an aluminum-containing layer.

15. The process according to claim 11, wherein the porous region is subjected to a pore-widening treatment after said anodic oxidation.

16. The process according to claim 11, wherein a bottom of the pores of the porous region reaches the layer.

17. The process according to claim 11, wherein said member is obtained by a process comprising the steps of forming the layer on a substrate and forming the porous region on the layer.

18. The process according to claim 11, wherein said electrode is an anode and said device is an electron-emitting device.

19. A process for producing a structure comprising the steps of:

(i) preparing a substrate having a layer containing at least one pore, wherein the pore penetrates the layer; and (ii) forming a wire in the pore by a heat treatment of the structure obtained in step (i), wherein the wire is made of (a) a material from the substrate, which said material comprises titanium or a titanium alloy and (b) a material from a gas.

* * * * *

UNITED STATES PATENT AND TRADEMARK OFFICE

CERTIFICATE OF CORRECTION

PATENT NO. : 6,855,025 B2
DATED : February 15, 2005
INVENTOR(S) : Tatsuya Iwasaki et al.

It is certified that error appears in the above-identified patent and that said Letters Patent is hereby corrected as shown below:

Column 2,
Line 52, "Co." should read -- Co, --; and
Line 64, "(0.2to" should read -- (0.2 to --.

Column 5,
Line 47, "in," should read -- in --.

Column 7,
Line 64, "hereof The" should read -- hereof. The --.

Column 8,
Line 4, "above;" should read -- above, --;
Line 29, "will," should read -- will --; and
Line 49, "A film" should read -- Al film --.

Column 9,
Line 14, "heat-eating" should read -- heat-treating --.

Column 11,
Line 50, "steps" should read -- the steps --.

Column 12,
Line 1, "temperatures" should read -- temperature --.

Signed and Sealed this

Twenty-eighth Day of June, 2005

JON W. DUDAS
*Director of the United States Patent and Trademark Office*